US005318639A

United States Patent [19]

Hayakawa et al.

[11] Patent Number: 5,318,639

[45] Date of Patent: Jun. 7, 1994

[54] METHOD OF MANUFACTURING GRAIN ORIENTED SILICON STEEL SHEETS

[75] Inventors: Yasuyuki Hayakawa; Ujihiro Nishiike; Bunjiro Fukuda, all of Chiba; Masataka Yamada, Kobe; Tetsuya Oishi, Kurashiki; Shigeru Yoshida, Kurashiki; Yoh Shimizu, Kurashiki, all of Japan

[73] Assignee: Kawasaki Steel Corporation, Japan

[21] Appl. No.: 950,465

[22] Filed: Sep. 24, 1992

[30] Foreign Application Priority Data

Oct. 1, 1991 [JP] Japan ..... 3-253597

[51] Int. Cl.[5] ..... C21D 9/46

[52] U.S. Cl. ..... 148/113; 148/500

[58] Field of Search ..... 148/113, 111, 112, 500

[56] References Cited

U.S. PATENT DOCUMENTS 4,888,066 12/1989 Yoshitomi et al. ..... 148/113

FOREIGN PATENT DOCUMENTS 61-79781 4/1986 Japan ..... 148/113

*Primary Examiner*—R. Dean
*Assistant Examiner*—Sikyin Ip
*Attorney, Agent, or Firm*—Austin R. Miller

[57] ABSTRACT

Method of manufacturing a grain oriented silicon steel sheet. An annealing separating agent mainly composed of MgO is coated on a surface of a decarburized silicon steel sheet. The silicon steel sheet is subjected to secondary recrystallization annealing and then purification annealing. The annealing separating agent contains Ti oxide or a Ti compound which can be oxidized by heating. The purification annealing is conducted in steps. A non-oxidizing atmosphere having a high nitrogen concentration is present in one step. A hydrogen atmosphere having a low nitrogen concentration is present in a subsequent step.

10 Claims, 1 Drawing Sheet

METHOD OF MANUFACTURING GRAIN ORIENTED SILICON STEEL SHEETS

BACKGROUND OF THE INVENTION

1. Field of the Invention

The present invention relates to a method of making a grain oriented silicon steel sheet suitable for use as an iron core for transformers or other electrical appliances. More particularly, the present invention pertains to a method of effectively manufacturing a grain oriented silicon steel sheet which exhibits excellent coating properties and which has reduced or no core loss as a result of stress-relieving annealing.

2. Description of the Related Art

Important properties of grain oriented silicon steel sheets include the magnetic properties of the steel sheet and the properties of the coating on the surface of the steel sheet, such as the insulation properties required when the steel sheets are laid on top of one another to manufacture an iron core. Also important are the peeling resistance properties required during manufacture. To improve the properties of the coating on the steel sheet, it is essential to improve the adhesion of a forsterite film generated during finish annealing.

It has been proposed to add a Ti compound, such as $TiO_2$, to improve the forsterite film. This proposal suggested adding the $TiO_2$ to the MgO, which is the main component of the annealing separating agent coated on the surface of the steel sheet prior to finish annealing. For example, Japanese Patent Publication No. 51-12451 discloses the technique of improving the uniformity and adhesion of a forsterite film by adding 2 to 40 parts by weight of Ti compound per 100 parts by weight of the Mg compound. Japanese Patent Publication No. 49-29409 describes the technique of improving the uniformity and adhesion of the forsterite film by adding 2 to 20 parts by weight of $TiO_2$ per 100 parts by weight of heavy low-active fine grains of MgO. From these disclosures are developed various other techniques: for example, Japanese Patent Laid-Open No. 50-145315 discloses eliminating a sunspot-like attached material made up of a Ti compound by using pulverized $TiO_2$ in the annealing separating agent. Japanese Patent Laid-Open No. 54-128928 discloses increasing the tension of the forsterite film by mixing $TiO_2$ and $SiO_2$ and a boric compound with MgO. Japanese patent Laid-Open No. 1-168817 discloses the technique of improving the core loss by mixing $TiO_2$, antimony sulfate and manganese nitride or ferromanganese nitride with MgO.

Although adding a Ti compound to the annealing separating agent may be effective to improve some properties of the coating, they strongly tend to increase core loss experienced as a result of stress-relieving annealing. This problem is described in Japanese patent Laid-Open No. 2-93021.

Many of the transformer iron cores made of a grain oriented silicon steel sheet are small core type iron cores called coiled cores. Since a stress is generated in such a coiled core when the coil is subjected to a mechanical external force during the deforming process in manufacture, and hence the magnetic properties thereof deteriorate, stress-relieving annealing must be conducted at about 800° C. to eliminate the stress. However, if a Ti compound is present in the annealing separating agent, a carbide of Ti or a selenide or sulfide of Ti is precipitated in the portion of the surface of the ferrite to which the processing stress is applied during stress-relieving annealing. Consequently, the movement of the magnetic domain wall is partially prevented and the core loss thus increases. Thus a steel sheet which generates less core loss, even when stress-relieving annealing is conducted, has long been desired for use in coiled cores.

To prevent the increased core loss which is caused by application of stress-relieving annealing to a silicon steel sheet having Ti in an annealing separating agent, it has been proposed in Japanese Patent Laid-Open No. 2-93021 to decrease the amount of precipitated carbide of Ti. This is proposed to be done by decreasing to 0.0015 weight percent or less the amount of carbon in the silicon steel sheet which is to be subjected to finish annealing. However, when using this technique it is difficult as a practical matter to restrict absorption of carbon dioxide into MgO, and it is essentially impossible to decrease the amount of sulfide or selenide of Ti. It is thus impossible to substantially restrict the core loss caused by stress-relieving annealing.

SUMMARY OF THE INVENTION

An object of the present invention is to provide a method of manufacturing a silicon steel sheet which can avoid increase of core loss caused by stress-relieving annealing when a Ti compound is contained in an annealing separating agent on the surface of the sheet, and to create a new method which generates less core loss or no core loss as a result of stress-relieving annealing, and which provides excellent coating properties on the product.

We have conducted substantial research to create such a method. We have now surprisingly discovered that precipitation of carbide or selenide or sulfide of Ti on the surface of a steel sheet can be advantageously restricted by providing a non-oxidizing atmosphere containing nitrogen in a high concentration in one stage of purification annealing. It is highly important that, in at least one stage of the purification annealing step, the annealing separating agent containing Ti must be exposed to an atmosphere containing a high concentration of nitrogen. It is further advantageous to provide a further step wherein the annealing separating agent is exposed to an atmosphere of hydrogen containing only a small portion of nitrogen or none.

As an illustrative example of the invention, we have conducted extensive tests on a silicon steel sheet whose composition consisted of 0.078 wt% (hereinafter simply indicated by %) of C, 3.3% of Si, 0.083% of Mn, 0.025% of Se, 0.020% of Al, 0.0089% of N, 0.025% of Sb, 0.09% of Cu and a balance of Fe. The sheet was heated at 1420° C. for 20 minutes and subjected to hot rolling to obtain a 2.0 mm-thick steel sheet. Next, the steel sheet was subjected to hot rolling sheet annealing at 1000° C. for 30 seconds and then cold rolling to obtain .a 1.5 mm-thick steel sheet. After intermediate annealing at 1100° C. for 2 minutes, the steel sheet was quenched at 30° C./sec. Thereafter, cold rolling was conducted to obtain a steel sheet having a finish thickness of 0.22 mm.

Thereafter, decarburization was conducted on the steel sheet at 840° C for 2 minutes in an atmosphere of wet hydrogen. An annealing separating agent containing 10 parts by weight of $TiO_2$ relative to 100 parts by weight of MgO was coated on the surface of the steel sheet. Secondary recrystallization annealing was then conducted in an atmosphere consisting of 25 vol% of nitrogen and 75 vol% of hydrogen at 1150° C. by increasing the temperature at a rate of 20° C/sec.

Subsequently, purification annealing was conducted at 1180° C in a mixed atmosphere consisting of 75 vol% of nitrogen and 25 vol% of hydrogen for various periods of time less than 60 minutes from the start of purification annealing, and then in a subsequent step in an atmosphere of hydrogen for the remaining 5 hours. After this purification annealing, an insulating coating mainly composed of magnesium phosphate was applied to the steel.

After stress-relieving annealing was conducted on the products for 3 hours at 800° C., the iron core loss ($W_{17/50}$) measured before stress-relieving annealing was compared with the iron loss ($W_{17/50}$) obtained after stress-relieving annealing. Also, the amount of Ti that was present in the ferrite of each of the products was measured by wet analysis.

FIG. 1 is a graph showing the relationship between the amount of Ti in the ferrite of the product and the difference before and after stress-relieving annealing $\Delta W_{17/50}$ (w/kg) illustrating the core loss that was caused by stress-relieving annealing.

As can be seen from FIG. 1, if the amount of Ti in the ferrite of the product is 30 ppm or less, the core loss caused by stress-relieving annealing can be reduced to less than 0.02 W/kg.

We have also examined the relationship between the concentration $\times$(vol%) of nitrogen in the atmosphere to which the steel is exposed in purification annealing and the time t (min) required for purification annealing to reduce the amount of Ti in the ferrite of the product to 30 ppm or less. FIG. 2 shows the results of these examinations. It is clear from FIG. 2 that we have found that the required time t, in minutes, can be expressed as:

$$t(\text{min}) = 668 - 19.1x + 0\ 171^2 - 4.42 \times 10^{-4}x^3 \quad (1)$$

where x is the concentration (vol%) of nitrogen in the annealing atmosphere.

Although it is not fully clarified why the present invention can eliminate or minimize core loss increase due to stress-relieving annealing, it is thought that in the usual case a mixture of MgO and the Ti compound contained in the annealing separating agent react with $SiO_2$ to form a blackened substrate coating. However, the remaining Ti used in the coating formation may be dissipated and moved into the ferrite due to the high temperature of the purification annealing step. Ti present in the ferrite is believed to combine with C, Se or N in the steel to precipitate a carbide, selenide or nitride of Ti which, after processing stress is applied after stress-relieving annealing, deteriorates the magnetic properties of the steel sheet.

In the present invention, since nitrogen is introduced at a high concentration at one stage of the purification annealing process, the aforementioned remaining Ti combines instead with nitrogen in the coating and stays in the coating in the form of TiN, instead of moving into the ferrite. Thus, resultant precipitation of carbide, selenide or nitride of Ti is prevented or at least severely restricted, thus preventing or minimizing an increase in the core loss.

Normally employed compositions of grain oriented silicon steel sheets can be used. A desired composition, for example, contains about 0.02 to 0.10% of C, 2.0 to 4.0% of Si, 0.02 to 0.20% of Mn, and 0.010 to 0.040% of S and/or Se. When necessary, 0.010 to 0.065% of Al, 0.0010 to 0.0150% of N, 0.01 to 0.20% cf Sb, 0.02 to 0.20% of Cu, 0.01 to 0.05% of Mo, 0.02 to 0.20% of Sn, 0.01 to 0.30% of Ge or 0.02 to 0.20% of Ni can also be added.

The preferred proportion of C ranges from about 0.03 to 0.10%. At less than about 0.02% of C, an excellent primarily recrystallized structure cannot be obtained. At more than about 0.10% of C, decarburization failure occurs and hence the magnetic properties of the steel deteriorate.

The presence of Si is necessary to increase the electric resistance of the product and to reduce eddy current losses. A desired proportion of Si is between about 2.0 and 4.0% because at less than about 2.0% of Si, crystal orientation deteriorates due to $\alpha$-$\gamma$ transformation during finish annealing. At more than about 4.0% of Si, a problem arises during cold rolling.

Mn, Se and S function as inhibitors. At less than about 0.02% of Mn or at less than about 0.010% of S and/or Se, Mn or S and/or Se do not function as inhibitors. Introduction of Mn in a proportion more than about 0.20% or of S and/or Se in a proportion more than about 0.040% is not practical because this requires too high a slab heating temperature. Thus, a desired proportion of Mn is between about 0.02 and 0.20% while a desired proportion of S and/or Se is between about 0.010 and 0.040%.

AlN, known as an inhibitor component, can also be used. To obtain excellent core loss, the addition of Al in a proportion from about 0.010 to 0.065% and N in a proportion from about 0.0010 to 0.0150% is desired. Presence of Al and N in proportions exceeding the aforementioned values increases the size of AlN while the presence of Al and N in proportions less than the aforementioned values is not enough to make them function as an inhibitor.

The addition of Sb and Cu increases the magnetic flux density. A desired proportion of Sb is between about 0.01 and 0.20%. At more than about 0.20% of Sb, the decarburization property deteriorates. At less than about 0.01% of Sb, the magnetic flux density does not increase. A desired proportion of Cu is between about 0.01 and 0.20%. At more than about 0.20%, the deoxidizing property deteriorates. At less than about 0.01%, the magnetic flux density does not increase.

Adding Mo improves the surface property. A desired proportion of Mo is between about 0.01 and 0.05%. At more than about 0.05%, the decarburization property deteriorates. At less than about 0.01% of Mo, the surface property does not improve.

Introduction of Sn, Ge and Ni improves the core loss. A desired proportion of Sn is between about 0.01 and 0.30% because the presence of Sn in a proportion exceeding about 0.30% does not provide excellent primarily recrystallized structure while the presence of Sn in a proportion less than about 0.01% is not enough to improve the core loss. Since introduction of Ni in a proportion exceeding about 0.20% reduces the hot rolling strength while that of N in a proportion less than about 0.01% is not enough to improve the core loss, a desired proportion of Ni is between about 0.01 and 0.20%.

Several method steps may be used in making a grain oriented silicon steel sheet for treatment according to the present invention.

Molten steel obtained by conventional steel making may be cast by continuous casting or ingot-making to obtain a slab. If necessary, blooming rolling is conducted to obtain the slab. After hot rolling and, if necessary, hot rolling annealing, the slab is subjected to cold rolling to obtain a cold rolled sheet having a final thickness. Cold rolling is conducted once or twice with intermediate annealing.

After decarburization is conducted on the final cold rolled sheet, an annealing separating agent is coated on the surface of the steel sheet. The annealing separating agent contains about 1.0 to 40 parts by weight (as $TiO_2$) of Ti oxide or Ti compound which can be oxidized by heating, relative to 100 parts by weight of MgO. Typical examples of Ti oxides or Ti compounds which can be oxidized by heating include $TiO_2$, $TiO_3$ $H_2O$, $TiO.(OH)_4$ and $Ti(OH)<$. The presence of a Ti oxide or a Ti compound which can be oxidized by heating in a proportion of about 1.0 parts by weight, in the form of $TiO_2$, relative to 100 parts by weight of MgO, cannot improve the coating property. Introduction of Ti oxide or Ti compound by more than about 40 parts by weight causes the brittleness rapidly to deteriorate.

Next, secondary recrystallization annealing is conducted on the steel sheet. Subsequently, the first part of purification annealing is conducted at a temperature ranging from about 1150 to 1250° C. in a non-oxidizing atmosphere having a nitrogen concentration of about 10 vol% or above. Thereafter, a hydrogen atmosphere whose nitrogen concentration is about less than 3 vol% or less is used. At a temperature lower than about 1150° C, Se or S cannot be removed sufficiently, and the magnetic property thus deteriorates. At a temperature higher than about 1250° C, the hot rolling strength reduces, and the coil shape thus deteriorates, making coiling impossible. Thus, a desired temperature for purification annealing is between about 1150° C. and 1250° C. A desired nitrogen concentration of the atmosphere used in the nitrogen-introduction part of the purification annealing process is about 10 vol% or above. At less than about 10 vol%, Ti enters the ferrite, causing the core loss due to stress-relieving annealing to deteriorate.

There is no limitation as to the kinds of components of the atmosphere that may be used for the remainder of the purification process as long as the atmosphere is nonoxidizing, which is required to form TiN. For example, a hydrogen plus inactive gas atmosphere can be used. The time t (min) required for annealing when the nitrogen concentration is 10 vol% or above depends on the nitrogen concentration x (vol%) and is given by the following equation:

$$t\ (\text{min}) = 66 - 19.1x + 1.171x^2 - 4.42 \times 10^{-4}x^3 \quad (1)$$

With an annealing time of less than t minutes, Ti enters the ferrite, and the core loss thus deteriorates when subjected to stress-relieving annealing.

A desired nitrogen concentration of the atmosphere used for the latter half of the purification annealing process is less than about 3 vol%. At about 3 vol% or above, nitrogen remains in the ferrite after annealing, and the magnetic property thus deteriorates.

Thereafter, an insulating coating, preferably, an insulating coating which also applies tension, is applied to the steel sheet to obtain a valuable product.

DETAILED DESCRIPTION OF THE PREFERRED EMBODIMENTS

Figure 1:
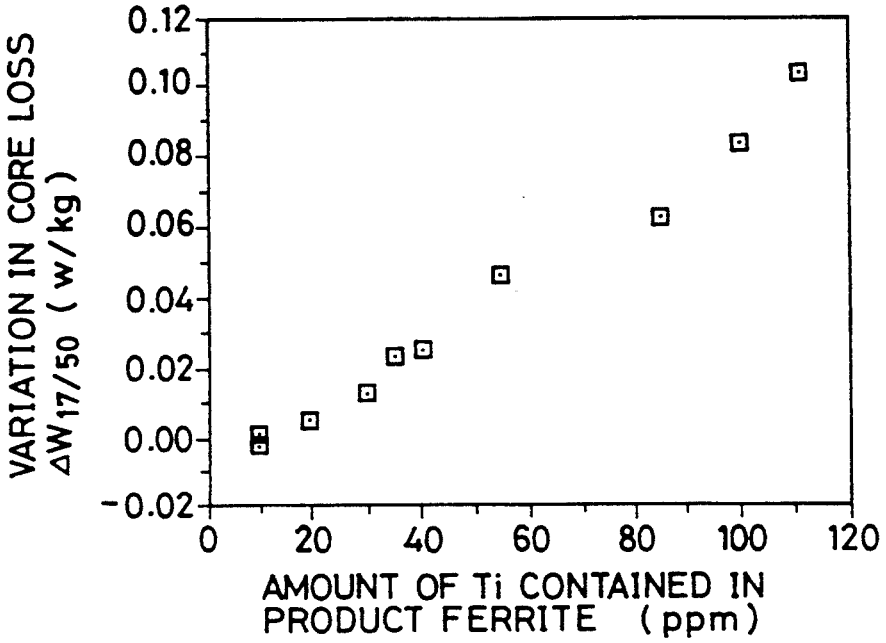
FIG. 1 is a graph showing the relationship between the amount of Ti in the product ferrite and the variation of core loss caused by stress-relieving annealing.
Figure 2:
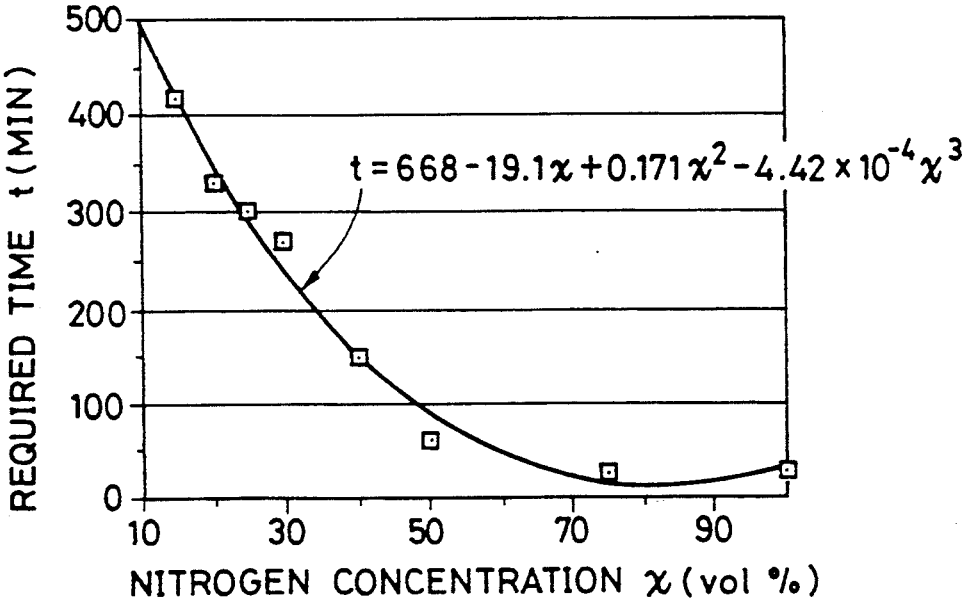
FIG. 2 is a graph showing the relationship between the nitrogen concentration x in the atmosphere present at purification annealing and the time required for purification annealing to reduce the amount of Ti in the product ferrite to 30 ppm or less.

Specific examples will be described for better understanding of the invention. These are intended to be illustrative but are not intended to limit the scope of the invention, which is defined in the appended claims.

First Example

A silicon steel slab, whose composition consisted of 0.044% of C, 3.23% of Si, 0.075% of Mn, 0.021% of Se, 0.026% f Sb and balance of Fe, was heated at 1420° C. for 30 minutes. It was then subjected to hot rolling to obtain a 2.0 mm-thick hot rolled sheet. Next, annealing was conducted on the steel sheet at 1000° C. for 1 minute and then cold rolling was performed to obtain a 0.60 mm-thick steel sheet. After intermediate annealing at 975° C. for 2 minutes, the steel sheet was subjected to cold rolling to obtain a steel sheet having a final thickness of 0.20 mm. Subsequently, decarburization annealing was conducted at 820° C. for 2 minutes. An annealing separating agent, in which $TiO_2$ was present in various amounts as listed in Table 1 relative to 100 parts by weight of MgO, was coated on the surface of the steel sheet. Secondary recrystallization annealing was conducted on the steel sheet at 850° C. for 50 hours in a nitrogen atmosphere. Thereafter, purification annealing was conducted at 1200° C. in various atmospheres as listed in Table 1 and for various times as listed in Table 1. After purification annealing, an insulating coating composed of colloidal SiO:, magnesium phosphate and chromic acid anhydride was performed. After the steel sheet was plastically processed in a toroidal form and then stretched in a straight line form, it was subjected to stress-relieving annealing at 800° C. for 3 hours. The core losses obtained after coating and after stress-relieving annealing are listed in Table 1.

TABLE 1

| No. | Proportion of $TiO_2$ per 100 parts by weight of MgO | First part of purification annealing: Atmosphere | First part of purification annealing: Time | Latter part of purification annealing: Atmosphere | Latter part of purification annealing: Time | Core loss after coating $W_{17/50}$ (W/kg) | Core loss after stress-relieving annealing $W_{17/50}$ (W/kg) | Variation in core loss $\Delta W_{17/50}$ (W/kg) | Appearance of coating | Division |
|---|---|---|---|---|---|---|---|---|---|---|
| 1 | 5 parts by weight | Nitrogen 25% Hydrogen 75% | 5 hours | Hydrogen 100% | 5 hours | 0.83 | 0.82 | −0.01 | Substantial | Present invention |
| 2 | 5 parts by weight | Nitrogen 50% Hydrogen 50% | 2 hours | Hydrogen 100% | 5 hours | 0.84 | 0.84 | 0 | Substantial | Present invention |

TABLE 1-continued

| No. | Proportion of $TiO_2$ per 100 parts by weight of MgO | First part of purification annealing Atmosphere | First part of purification annealing Time | Latter part of purification annealing Atmosphere | Latter part of purification annealing Time | Core loss after coating $W_{17/50}$ (W/kg) | Core loss after stress-relieving annealing $W_{17/50}$ (W/kg) | Variation in core loss $\Delta W_{17/50}$ (W/kg) | Appearance of coating | Division |
|---|---|---|---|---|---|---|---|---|---|---|
| 3 | 5 parts by weight | Nitrogen 50% Argon 50% | 2 hours | Hydrogen 100% | 5 hours | 0.82 | 0.82 | 0 | Substantial | Present invention |
| 4 | 5 parts by weight | Nitrogen 100% | 1 hour | Hydrogen 100% | 5 hours | 0.84 | 0.83 | −0.01 | Substantial | Present invention |
| 5 | 5 parts by weight | Nitrogen 100% | 30 minutes | Hydrogen 100% | 5 hours | 0.85 | 0.86 | 0.01 | Substantial | Present invention |
| 6 | 5 parts by weight | Nitrogen 15% Hydrogen 85% | 5 hours | Hydrogen 100% | 5 hours | 0.83 | 0.89 | 0.06 | Substantial | Comparative example |
| 7 | 5 parts by weight | Nitrogen 50% Hydrogen 50% | 10 minutes | Hydrogen 100% | 5 hours | 0.82 | 0.91 | 0.09 | Substantial | Comparative example |
| 8 | 5 parts by weight | Nitrogen 50% Hydrogen 50% | 5 hours | Nitrogen 50% Hydrogen 50% | 5 hours | 0.89 | 0.89 | 0 | Substantial | Comparative example |
| 9 | 0.5 parts by weight | Nitrogen 50% Hydrogen 50% | 5 hours | Hydrogen 100% | 5 hours | 0.83 | 0.83 | 0 | Non-uniform | Comparative example |
| 10 | 50 parts by weight | Nitrogen 50% Hydrogen 50% | 5 hours | Hydrogen 100% | 5 hours | 0.83 | 0.83 | 0 | Surface cracked | Comparative example |

The core losses of 0.82 to 0.86 as in experiments 1-5 are considered excellent, but core losses of 0.91 and 0.89 as in experiments 7 and 8 are unfavorable. The high core loss in experiment 8 was caused by the use of too much nitrogen (50%) in the latter stage of purification annealing.

SECOND EXAMPLE

A silicon steel slab, whose composition consisted of 0.071% of C, 3.34% of Si, 0.069% of Mn, 0.021% of S, 0.025% of Al, 0.0083% of N, 0.12% of Cu, 0.029% of Sb and balance of Fe, was heated at 1430° C. for 30 minutes. It was subjected to hot rolling to obtain a 2.2 mm-thick hot rolled sheet. Annealing was conducted on the steel sheet at 1000° C. for 1 minute and cold rolling was performed to obtain a 1.5 mm-thick steel sheet. After intermediate annealing at 1100° C. for 2 minutes, the steel sheet was subjected to quenching at a rate of 30° C./sec and then cold rolling to obtain a steel sheet having a final thickness of 0.23 mm. Subsequently, decarburization annealing was conducted at 820° C. for 2 minutes. An annealing separating agent, in which $TiO_2$ was present in various amounts as listed in Table 2 relative to 100 parts by weight of MgO, was coated on the surface of the steel sheet, the steel sheet was held in a nitrogen atmosphere at 850° C. for 20 hours and was then subjected to secondary recrystallization annealing, in an atmosphere of 75 vol% of hydrogen and 25 vol% of nitrogen, by increasing the temperature up to 1150° C. at a rate of 12° C/h. Thereafter, purification annealing was conducted at 1200° C. in various atmospheres as listed in Table 2, and for various times also listed in Table 2. After purification annealing, an insulating coating composed of colloidal $SiO_2$, magnesium phosphate and chromic acid anhydride was performed. After the steel sheet was plastically processed in a toroidal form and then stretched in a straight line form, it was subjected to stress-relieving annealing at 800° C. for 3 hours. The core losses obtained after coating and those obtained after stress-relieving annealing are listed in Table 2.

TABLE 2

| No. | Proportion of $TiO_2$ per 100 parts by weight of MgO | First part of purification annealing Atmosphere | First part of purification annealing Time | Latter part of purification annealing Atmosphere | Latter part of purification annealing Time | Core loss after coating $W_{17/50}$ (W/kg) | Core loss after stress-relieving annealing $W_{17/50}$ (W/kg) | Variation in core loss $\Delta W_{17/50}$ (W/kg) | Appearance of coating | Division |
|---|---|---|---|---|---|---|---|---|---|---|
| 11 | 10 parts by weight | Nitrogen 25% Hydrogen 75% | 5 hours | Hydrogen 100% | 5 hours | 0.84 | 0.84 | 0 | Substantial | Present invention |
| 12 | 10 parts by weight | Nitrogen 50% Hydrogen 50% | 2 hours | Hydrogen 100% | 5 hours | 0.85 | 0.85 | 0 | Substantial | Present invention |
| 13 | 10 parts by weight | Nitrogen 50% Argon 50% | 2 hours | Hydrogen 100% | 5 hours | 0.84 | 0.84 | 0 | Substantial | Present invention |
| 14 | 10 parts by weight | Nitrogen 100% | 1 hour | Hydrogen 100% | 5 hours | 0.85 | 0.84 | −0.01 | Substantial | Present invention |
| 15 | 20 parts by weight | Nitrogen 20% Hydrogen 80% | 5 hours | Hydrogen 100% | 5 hours | 0.86 | 0.86 | 0 | Substantial | Present invention |
| 16 | 10 parts by weight | Nitrogen 15% Hydrogen 85% | 5 hours | Hydrogen 100% | 5 hours | 0.84 | 0.91 | 0.07 | Substantial | Comparative example |

TABLE 2-continued

| No. | Proportion of $TiO_2$ per 100 parts by weight of MgO | First part of purification annealing Atmosphere | Time | Latter part of purification annealing Atmosphere | Time | Core loss after coating $W_{17/50}$ (W/kg) | Core loss after stress-relieving annealing $W_{17/50}$ (W/kg) | Variation in core loss $\Delta W_{17/50}$ (W/kg) | Appearance of coating | Division |
|---|---|---|---|---|---|---|---|---|---|---|
| 17 | 10 parts by weight | Nitrogen 50% Hydrogen 50% | 10 minutes | Hydrogen 100% | 5 hours | 0.84 | 0.94 | 0.10 | Substantial | Comparative example |
| 18 | 10 parts by weight | Nitrogen 50% Hydrogen 50% | 5 hours | Nitrogen 25% Hydrogen 75% | 5 hours | 0.90 | 0.90 | 0 | Substantial | Comparative example |
| 19 | 0.5 parts by weight | Nitrogen 50% Hydrogen 50% | 5 hours | Hydrogen 100% | 5 hours | 0.85 | 0.85 | 0 | Non-uniform | Comparative example |
| 20 | 50 parts by weight | Nitrogen 50% Hydrogen 50% | 5 hours | Hydrogen 100% | 5 hours | 0.86 | 0.86 | 0 | Surface cracked | Comparative example |

The high core loss of 0.90 in experiment 18 was caused by the presence of too much nitrogen (25%) in the latter stage of purification annealing. Third Example Silicon steel slabs having various compositions listed in Table 3 were prepared.

These slabs were heated at 1430° C for 30 minutes, and then were subjected to hot rolling to obtain 2.2 mm-thick hot rolled sheets. After annealing the steel sheets at 1000° C. for 1 minute, cold rolling was performed to obtain 1.5 mm-thick steel sheets. After intermediate annealing at 1100° C. for 2 minutes, the steel sheets were subjected to cold rolling to obtain steel sheets having a final thickness of 0.23 mm. Subsequently, decarburization annealing was conducted at 820° C. for 2 minutes. After an annealing separating agent, in which 10 parts by weight of TiO: was present relative to 100 parts by weight of MgO, was coated on the surface of each of the steel sheets, the steel sheet was held in a nitrogen atmosphere at 850° C. for 20 hours and was then subjected to secondary recrystallization annealing in an atmosphere of 75 vol% of hydrogen and 25 vol% of nitrogen, by increasing the temperature up to 1150° C. at a rate of 12° C./h. Thereafter, purification annealing was conducted at 1200° C in an atmosphere composed of 50 vol% of hydrogen and 50 vol% of nitrogen for the first 5 hours and in an atmosphere of hydrogen for the subsequent 5 hours. After purification annealing, an insulating coating composed of colloidal $SiO_2$, magnesium phosphate and chromic acid anhydride was applied. After the steel sheet was plastically processed in a toroidal form and then stretched in a straight line form, it was subjected to stress-relieving annealing at 800° C. for 3 hours. The core loss variations obtained after coating and after stress-relieving annealing were all zero, as listed in Table 3.

provide a silicon steel sheet which is free from increased core losses due to stress-relieving annealing and which exhibits excellent coating properties.

We claim:

1. In a method of manufacturing a grain oriented silicon steel sheet in which an annealing separating agent containing MgO is coated on a surface of a decarburized silicon steel sheet, and the silicon steel sheet is subjected to secondary recrystallization annealing and then purification annealing, the steps which comprise:

incorporating into said annealing separating agent Ti oxide or a Ti compound which can be oxidized by heating, conducting a portion of said purification annealing while exposing said annealing separating agent to a non-oxidizing atmosphere having a high nitrogen concentration for at least the first t minutes as expressed by the following equation:

$$t(\text{min}) = 668 - 191x + 0.171x^2 - 4.42 \times 10^{-4}x^3$$

where x is the nitrogen concentration (vol%), to reduce an amount of Ti in the ferrite of the silicon steel to 30 ppm or less, further purification annealing the silicon steel sheet while exposing said annealing separating agent to a non-oxidizing gas having a low nitrogen concentration so that nitrogen remaining in the ferrite after annealing would not deteriorate the magnetic properties, and subjecting said sheet to purification annealing.

2. The method defined in claim 1, wherein said non-oxidizing gas is hydrogen.

3. The method defined in claim 1, wherein said nitrogen concentration in said further purification annealing is less than 3% by volume.

4. A method of manufacturing a grain oriented silicon steel sheet in which an annealing separating agent con-

TABLE 3

| | Silicon Steel Chemical Composition (%) C | Si | Mn | Se | sol. Al | N | Sb | Cu | Mo | Sn | Ge | Ni | Variation in core loss $\Delta W_{17/50}$ (W/kg) | Division |
|---|---|---|---|---|---|---|---|---|---|---|---|---|---|---|
| 21 | 0.065 | 3.45 | 0.089 | 0.025 | 0.022 | 0.0085 | tr | 0.01 | tr | 0.01 | tr | 0.01 | 0 | Present Invention |
| 22 | 0.066 | 3.43 | 0.070 | 0.024 | 0.025 | 0.0097 | 0.028 | 0.01 | tr | 0.01 | tr | 0.01 | 0 | |
| 23 | 0.064 | 3.39 | 0.071 | 0.015 | 0.027 | 0.0087 | tr | 0.14 | tr | 0.01 | tr | 0.01 | 0 | |
| 24 | 0.077 | 3.32 | 0.077 | 0.021 | 0.025 | 0.0085 | tr | 0.01 | tr | 0.17 | tr | 0.01 | 0 | |
| 25 | 0.079 | 3.41 | 0.084 | 0.022 | 0.024 | 0.0088 | tr | 0.01 | tr | 0.01 | 0.15 | 0.01 | 0 | |
| 26 | 0.071 | 3.36 | 0.065 | 0.022 | 0.024 | 0.0081 | tr | 0.01 | tr | 0.01 | tr | 0.09 | 0 | |
| 27 | 0.081 | 3.49 | 0.075 | 0.020 | 0.022 | 0.0086 | tr | 0.01 | 0.03 | 0.01 | tr | 0.01 | 0 | |

As will be understood from the foregoing description, it is possible according to the present invention to taining MgO is coated on a surface of a decarburized silicon steel sheet, and wherein the silicon steel sheet is subjected to secondary recrystallization annealing and then purification annealing, the improvement wherein said annealing separating agent contains about 1.0 to 40 parts by weight of Ti oxide or a Ti compound which can be oxidized by heating, per 100 parts by weight of MgO, wherein the purification annealing step is conducted as at least two stages, one stage being conducted at a temperature ranging from about 11500 to 1250° C. in a non-oxidizing atmosphere having a nitrogen concentration of about 10 vol% or above for at least the first t minutes as expressed by the following equation:

$$t\ (\text{min}) = 668 - 191x + 0.171x^2 - 4.42 \times 10^{-4}x^3 \quad (1)$$

where x is the nitrogen concentration (vol%) in the annealing atmosphere, and another stage being conducted in a reducing atmosphere having a nitrogen concentration of less than about 3 vol%.

5. The method defined in claim 1, wherein the amount of Ti compound in the annealing separating agent, expressed as $TiO_2$, is in the range of about 1.0 to about 40 parts by weight per 100 parts by weight of MgO contained in said annealing separating agent.

6. The method defined in claim 1, wherein the purification annealing temperature while the annealing separating agent is exposed to said non-oxidizing atmosphere having a high nitrogen concentration is in the range of about 1150–1250° C.

7. The method defined in claim 1, wherein the nitrogen concentration in said non-oxidizing atmosphere having a high nitrogen concentration is at least about 10% by volume.

8. In a method of manufacturing a grain oriented silicon steel sheet in which an annealing separating agent containing MgO is coated on the surface of a decarburized silicon steel sheet, and the silicon steel sheet is subjected to secondary recrystallization annealing and then purification annealing, the steps comprising:

decarburizing the silicon steel sheet;

incorporating into said annealing separating agent Ti oxide or a Ti compound which can be oxidized by heating in an amount between about 1.0 to 40 parts by weight of Ti oxide or Ti compound to 100 parts by weight of MgO;

applying the resulting annealing separating agent onto the silicon steel sheet;

secondary recrystallization annealing the silicon steel sheet;

purification annealing the silicon steel sheet at a temperature range from about 1150°–1250° C. in a non-oxidizing atmosphere having a nitrogen concentration of about 10 vol % or more for at least the first t minutes as expressed by the following equation:

$$t\ (\text{min}) = 668 - 191x + 0.171x^2 - 4.42 \times 10^{-4}x^3$$

where x is the nitrogen concentration (vol%);

further purification annealing the silicon steel sheet at a temperature ranging from about 1150°–1250° C. in a non-oxidizing atmosphere having a nitrogen concentration of about less than 3 vol %; and stress relief annealing said silicon steel sheet.

9. The method defined in claim 8 further comprising applying an insulating coating to said silicon steel sheet subsequent to purification annealing and prior to stress relief annealing.

10. The method defined in claim 9 further comprising coiling said silicon steel sheet subsequent to said insulating step and prior to said stress relief annealing step.

* * * * *

UNITED STATES PATENT AND TRADEMARK OFFICE

CERTIFICATE OF CORRECTION

PATENT NO. : 5,318,639

DATED : June 7, 1994

INVENTOR(S) : Yasuyuki Hayakawa et al

It is certified that error appears in the above-indentified patent and that said Letters Patent is hereby corrected as shown below:

In Column 3, line 37, please delete
"$t(min) = 668 - 19.1x + 0\ 171^2 - 4.42 \times 10^{-4}x^3$"
and substitute
--$t(min) = 668 - 19.1x + 0.171x^2 - 4.42 \times 10^{-4}x^3$--.

In Column 5, line 13, delete "Ti(OH)<" and substitute --$Ti(OH)_4$--.

In Column 6, line 49, please delete "SiO:" and substitute --$SiO_2$--.

In Column 9, line 35, please change "TiO:" and substitute --$TiO_2$--.

In Column 11, line 11, delete "11500" and substitute --1150--;
line 17, delete
"$t(min) = 668 - 191x + 0.171x^2 - 4.42 \times 10^{-4}x^3$"
and substitute
--$t(min) = 668 - 19.1x + 0.171x^2 - 4.42 \times 10^{-4}x^3$--.

UNITED STATES PATENT AND TRADEMARK OFFICE

CERTIFICATE OF CORRECTION

PATENT NO. : 5,318,639

DATED : June 7, 1994

INVENTOR(S) : Yasuyuki Hayakawa et al

It is certified that error appears in the above-indentified patent and that said Letters Patent is hereby corrected as shown below:

In Column 12, line 23, delete

"$t(min) = 668 - 191x + 0.171x^2 - 4.42 \times 10^{-4}x^3$"

and substitute

--$t(min) = 668 - 19.1x + 0.171x^2 - 4.42 \times 10^{-4}x^3$--.

Signed and Sealed this

Twenty-third Day of August, 1994

*Attest:*

Bruce Lehman

BRUCE LEHMAN

*Attesting Officer*

*Commissioner of Patents and Trademarks*